US005876520A

United States Patent [19]

Takashima et al.

[11] Patent Number: 5,876,520

[45] Date of Patent: Mar. 2, 1999

[54] SEMIPROCESSED NONORIENTED MAGNETIC STEEL SHEET HAVING EXCELLENT MAGNETIC CHARACTERISTICS AND METHOD FOR MAKING THE SAME

[75] Inventors: Minoru Takashima; Akio Fujita; Keiji Sato; Masaki Kawano, all of Kurashiki, Japan

[73] Assignee: Kawasaki Steel Corporation, Japan

[21] Appl. No.: 930,396

[22] PCT Filed: Feb. 6, 1997

[86] PCT No.: PCT/JP97/00287

§ 371 Date: Sep. 30, 1997

§ 102(e) Date: Sep. 30, 1997

[87] PCT Pub. No.: WO97/30180

PCT Pub. Date: Aug. 21, 1997

[30] Foreign Application Priority Data

Feb. 15, 1996 [JP] Japan ..... 8-27771

[51] Int. Cl.[6] ..... H01F 1/14; H01F 1/147

[52] U.S. Cl. ..... 148/306; 148/111; 420/117

[58] Field of Search ..... 148/110–113, 120–122, 148/306, 307; 420/117

[56] References Cited

U.S. PATENT DOCUMENTS

| | | | |
|---|---|---|---|
| 4,946,519 | 8/1990 | Honda et al. | 148/307 |
| 5,259,892 | 11/1993 | Kubota et al. | 148/111 |
| 5,413,640 | 5/1995 | Manabe et al. | 148/111 |

*Primary Examiner*—John Sheehan
*Attorney, Agent, or Firm*—Austin R. Miller

[57] ABSTRACT

The present invention relates to a semiprocessed nonoriented magnetic steel sheet which is used in iron cores of motors and transformers, finished to a final product by rolling having a reduction rate of 2 to 18% after final annealing by a manufacturer, and assures desired magnetic characteristics due to coarsening of crystal grains during strain-relief annealing after processing by a user. The excellent magnetic characteristics can be achieved by increasing lubrication during second cold rolling so as to satisfy the equation: $e_c \leqq e_s \leqq 1.18e_c$ wherein $e_s$ represents a strain value at the surface layer of the steel sheet and $e_c$ represents a strain value at the central layer.

8 Claims, 4 Drawing Sheets

SEMIPROCESSED NONORIENTED MAGNETIC STEEL SHEET HAVING EXCELLENT MAGNETIC CHARACTERISTICS AND METHOD FOR MAKING THE SAME

TECHNICAL FIELD

The present invention relates to a semiprocessed nonoriented magnetic steel sheet having excellent magnetic characteristics and a method for making the same. In particular, the magnetic characteristics are effectively improved by a modification of a cold rolling step.

BACKGROUND ART

Nonoriented magnetic steel sheets have been primarily used in iron cores of motors and transformers. For improving the energy efficiency of motors and transformers it is essential to increase the magnetic flux density and simultaneously to decrease the iron loss of the nonoriented magnetic steel sheet used in the iron core. In particular, semiprocessed nonoriented magnetic steel sheets are products rolled at rolling reduction rate of 2 to 18% after final annealing in manufacture's plants. Stress relief annealing by users after processing causes coarsening of crystal grains and assures desired magnetic characteristics.

Many ideas have been disclosed for improving magnetic characteristic, that is, increasing the magnetic flux density and decreasing the iron loss. Improvement in second cold rolling processes is disclosed in, for example, Japanese Patent Publication No. 4-34614, in which second cold rolling is performed at a rolling reduction rate of 2 to 18% and a controlled rolling speed of 500 to 2,000 mpm in order to improve magnetic characteristics in a low magnetic field. High-rate rolling of 500 mpm or more, however, increases cost. Further, magnetic characteristics do not reach the severe levels recently required.

Japanese Patent Laid-Open No. 58-9927 discloses a method for adding B so that the B/N ratio is 0.65 to 1.5, and Japanese Patent Laid-Open No. 60-39121 discloses a method for annealing hot-rolled sheets after an addition of 0.01 to 0.30 wt% of Sb. These methods, however, increase cost due to the addition of B or Sb and the annealing of hot-rolled steel sheets. Further, magnetic characteristics do not reach the severe levels recently required.

It is an object of the present invention to effectively solve the above-mentioned problems and to provide a semiprocessed nonoriented magnetic steel sheet having excellent magnetic characteristics and a method for making the same.

The present inventors have conducted intensive research to achieve the above-mentioned object. As a result, it has been discovered that a strain value applied to the steel sheet and the ratio of the strain value applied to the surface section to the strain value applied to the central section have a great influence on magnetic characteristics after stress relief annealing.

The experimental results which have been conducted in respect of the present invention will now be described.

A steel having a composition shown in Table 1 was prepared by a melting process and subjected to continuous casting to form slabs which were subjected to hot rolling to a thickness of 2.2 mm then first cold rolling to an intermediate thickness of 0.526 mm. After intermediate annealing at 800° C. for 20 seconds, second cold rolling with a rolling reduction of 5% was performed under conditions represented by X and Y in Table 2 to prepare a second cold rolled sheet having a final thickness of 0.50 mm.

Epstein test pieces of 280 mm by 30 mm were prepared from a second cold rolled steel sheet so that the long sides of 8 pieces among them agree with the rolling direction and the long sides of the residual 8 pieces agree with the direction perpendicular to the rolling direction. These test pieces were subjected to strain-relief annealing at 750° C. for 2 hours to measure magnetic characteristics.

At the same time, strain values of the second cold rolled steel sheet were determined at a surface layer, at an inner layer corresponding to one fifth of the thickness from the surface (hereinafter referred to as one-fifth layer) and at the central layer. Each strain value was calculated from the width (integral width) of the {222} X-ray diffraction profile of the test piece prepared as follows.

[TABLE 1]

| Component | C | Si | Mn | Al | P |
|---|---|---|---|---|---|
| Content (wt %) | 0.0025 | 0.58 | 0.60 | 0.70 | 0.02 |

[TABLE 2]

| | Conditions of second cold rolling | | | | | | | |
|---|---|---|---|---|---|---|---|---|
| Condition | Rolling temp. (°C.) | Viscosity of lubricating oil at 25° C. (cSt) | Rolling speed (mpm) | $e_s$ ($\times 10^{-4}$) | $e_c$ ($\times 10^{-4}$) | $e_s/e_c$ | $B_{50}$ (T) | $W_{15/50}$ (w/kg) |
| X | 10 | 105 | 300 | 6.5 | 5.9 | 1.10 | 1.76 | 2.62 |
| Y | 40 | 1.0 | 300 | 7.6 | 5.9 | 1.29 | 1.72 | 3.16 |

Three 30 mm by 30 mm test pieces were sampled from the second cold rolled sheet. One of them was dipped into an aqueous 5% nitric acid solution at 25° C. for 60 seconds to remove iron over 5 $\mu$m from the surface and used as a test piece for the surface layer. The residual two test pieces were subjected to electrolytic etching so that the one-fifth layer and the central layer appeared on the surfaces, respectively, and were dipped into an aqueous 5% nitric acid solution at 25° C. for 60 seconds to prepare test pieces for the one-fifth layer and the central layer.

The strain value was calculated from the width of the {222} reflected X-ray diffraction profile as follows. A {222} reflected X-ray diffraction profile was provided using an X-ray diffractometer. Diffraction components due to the background and a $K_\beta$ line contained in the X-ray diffraction profile were removed. FIG. 1 is a schematic figure of a {222} X-ray diffraction profile after removal of the background and the like, wherein θ (unit: deg.) represents a diffraction angle, I(2θ) represents an intensity of the X-ray at an diffraction angle θ and has a unit of counts per second (cps), and $\theta_p$ represents a diffraction angle in which the intensity of the {222} diffraction profile reaches a maximum $I_p$. The width (integral width) of the X-ray diffraction profile was calculated using the following equation:

$$B(\text{deg})=(1/I_p)\int I(2\theta)d\theta$$

wherein Ip represents the peak intensity and I(2θ) represents the intensity at 2θ.

The integral width $B_0$ of a comparative sample which was not subjected to second cold rolling was similarly determined and an increased width b due to strain was calculated using the following equation:

$$b=(B^2-B_0^2)^{1/2}$$

The strain e was determined from the following equation:

$$e=(b/4 \tan \theta_p)\cdot(\pi/180)$$

The strain e determined from the diffraction profile of the surface layer was expressed as $e_s$, and that determined from the diffraction profile of the central layer was expressed as $e_c$.

FIG. 2 is a graph showing a strain distribution after second cold rolling along the thickness.

The strain values and the ratio of the strain values in terms of the surface layer and the central layer after second cold rolling and magnetic characteristics after strain-relief annealing are also shown in Table 2.

FIG. 2 evidently demonstrates that the strain at the surface layer is higher than that in the central layer in all of the cases, and condition (X) has a lower difference of the strain values between the surface layer and the central layer.

Table 2 also demonstrates that test piece which is second cold rolled under condition (X) has superior magnetic characteristics.

As described above, test piece which is second cold rolled under condition (X) has superior magnetic characteristics probably due to use of a high-viscosity lubricating oil and low-temperature rolling in condition (X).

FIG. 3 is a graph showing correlations between $e_s/e_c$ values and magnetic characteristics in various second cold rolling conditions.

FIG. 3 demonstrates that excellent magnetic characteristics are achieved if $e_s/e_c$ value is 1.00 or more and 1.18 or less, i.e., $1.18e_c \geqq e_s \geqq e_c$.

A reason that magnetic characteristics are effectively improved when the difference in strain values between the central layer and the surface layer is decreased by adjusting the second cold rolling condition is probably due to suppressed growth of the {111} fine texture which adversely affects magnetic characteristics.

The present inventors have also investigated the effects of compositions and discovered that the amount of sol. Al significantly affects magnetic characteristics.

Steels having different sol. Al contents as shown in Table 3 were prepared from melts, continuously cast into slabs, hot-rolled into a hot-rolled sheet having a thickness of 2.2 mm, and subjected to first cold rolling to decrease the thickness to 0.526 mm. The sheet was subjected to intermediate annealing at 800° C. for 10 seconds and second cold rolling with a 5% reduction rate under various conditions.

[TABLE 3]

| | Composition (wt %) | | | | |
|---|---|---|---|---|---|
| Steel | C | Si | Mn | sol. Al | P |
| A | 0.0020 | 1.3 | 0.2 | 0.0002 | 0.01 |
| B | 0.0020 | 1.3 | 0.2 | 0.0008 | 0.01 |
| C | 0.0020 | 1.3 | 0.2 | 0.0010 | 0.01 |
| D | 0.0020 | 1.3 | 0.2 | 0.0015 | 0.01 |
| E | 0.0020 | 1.3 | 0.2 | 0.20 | 0.01 |
| F | 0.0020 | 1.3 | 0.2 | 0.40 | 0.01 |

FIG. 4 is a graph showing the correlations between $e_s/e_c$ values and magnetic characteristics of the resulting product sheets.

FIG. 4 demonstrates that magnetic characteristics are improved by controlling $e_s/e_c$ value within a range of 1.18 to 1.00 regardless of sol. Al contents. The magnetic characteristics are further improved for a sol. Al content of 10 ppm or less.

Therefore, superior magnetic characteristics can be achieved by controlling the sol. Al content to be 10 ppm or less and $e_s/e_c$ value to be 1.18 to 1.00. Growth of the {111} fine texture adversely affecting magnetic characteristics is probably further suppressed by such synergistic effects.

Preferable ranges of compositions in accordance with the present invention will now be described.

C: 0.05 percent by weight or less

Since C deteriorate magnetic characteristics due to carbide deposition, it is preferable that the C content is 0.05 percent by weight or less.

Si: 5.0 percent by weight or less

Si increases specific resistance and effectively contributes to improvement in iron loss. Since an excessive amount of addition, however, deteriorates cold rolling characteristics, it is preferable that the Si content is 5.0 percent by weight or less. Also, it is preferable that the Si content is 1.0 percent by weight or more in view of iron loss.

Mn: 2.0 percent by weight or less

Mn increases specific resistance and improves iron loss. Since an excessive amount of addition, however, deteriorates magnetic flux density, it is preferable that the Mn content is 2.0 percent by weight or less. Also, it is preferable that the Mn content is 0.05 percent by weight or more in order to suppress surface defects due to cracking during hot rolling.

P: 0.2 percent by weight or less

P improves punching characteristics. Since an excessive amount of addition, however, deteriorates cold rolling characteristics, it is preferable that the P content is 0.2 percent by weight or less.

Sol. Al: 10 ppm or less

It is preferable that the sol. Al content is 10 ppm or less because synergistic effects can be achieved in combination with control of $e_s/e_c$ value within a range of 1.18 to 1.00 as described above. Since a sol. Al content of less than 0.05 ppm increases cost, it is preferable that the sol. Al content is 0.05 ppm or more.

The production method in accordance with the present invention will now be described.

A molten steel having a composition as described above is prepared using a known apparatus such as a converter or a degassing apparatus and cast into a slab. The slab is subjected to hot rolling to form a hot-rolled sheet.

The hot-rolled sheet is subjected to hot-rolled sheet annealing at, for example, 850°to 950° C. for several hours, if necessary. The sheet is subjected to first cold rolling, intermediate annealing and second cold rolling. The intermediate annealing is performed at generally 650°to 1,000° C. and preferably 700°to 800° C.

Conditions for second cold rolling are particularly important in the present invention. Second cold rolling introduces a moderate strain to the steel sheet and adjusts $e_s/e_c$ the ratio of the strain value $e_s$ at the surface layer to the strain value $e_c$ at the central layer to an appropriate range.

Therefore, the rolling reduction rate in the second cold rolling must be 2% or more and 18% or less. When the rolling reduction rate is less than 2% or over 18%, an appropriate amount of strain is not introduced to the steel sheet and that causes unsatisfactory grain growth after strain-relief annealing. As a result, excellent iron loss cannot be achieved.

It is preferable that $e_s/e_c$ value is controlled within a range of 1.00 to 1.18.

In conventional second cold rolling, $e_s/e_c$ value is generally 1.2 or more. But, $e_s/e_c$ value can be controlled within a range of 1.00 to 1.18 by increasing lubrication during second cold rolling, for example, as described below.

A lubricating oil must be applied so as to sufficiently spread over the entire sheet surface. Positions wherein the lubricating oil does not spread have unsatisfactory lubricating characteristics. The viscosity of the lubricating oil is preferably as high as possible, i.e, 20 cSt or more. Lubricating characteristics are also improved by additives contributing to an increasing oil film thickness, e.g. oiliness improvers, such as higher fatty acids and fatty acid esters, and extreme pressure additives, such as sulfide fat and chlorinated paraffin. The amounts of such additives to be added must be optimized so as to exhibit the most satisfactory lubricant characteristics.

The temperature of the steel sheet generally rises to 40° C. or more during second cold rolling due to processing heating. The lubricating oil deteriorates and the lubricating characteristics decrease as the temperature of the steel sheet increases. Thus, it is important to control the temperature of the lubricating oil to keep at a low temperature so that the temperature of the sheet does not exceed 25° C.

Effective methods to control $e_s/e_c$ value to within 1.00 to 1.18 include a combination of a sufficient amount of lubricating oil as described above with a method for improving lubricating characteristics, i.e., use of lubricating oil having a viscosity of 20 cSt or more, use of an additive to effectively increase the oil film thickness, or a method for controlling the steel sheet to a temperature of 25° C. or less and preferably 10° C. or less.

Control of the strain values and $e_s/e_c$ value to within appropriate ranges can suppress growth of the {111} fine texture and achieve satisfactory magnetic characteristics.

Additional annealing or formation of an insulating film on the steel sheet surface may be employed after second cold rolling.

DISCLOSURE OF THE INVENTION

The present invention relates to a semiprocessed nonoriented magnetic steel sheet having excellent magnetic characteristics containing 5.0 percent by weight or less of Si, having a rolling reduction rate of 2 to 18%, and satisfying the following equation:

$$e_c \leqq e_s \leqq 1.18 e_c$$

wherein $e_s$ represents a strain value at the surface layer of the steel sheet and $e_c$ represents a strain value at the central layer.

The present invention also relates to a method for making a semiprocessed nonoriented magnetic steel sheet comprising a series of steps for hot-rolling a silicon steel material containing 5.0 percent by weight or less of Si, first cold rolling, intermediate annealing and second cold rolling; the step for second cold rolling being performed at a rolling reduction rate of 2 to 18% and under a condition satisfying the following equation:

$$e_c \leqq e_s \leqq 1.18 e_c$$

wherein $e_s$ represents a strain value at the surface layer of the steel sheet and $e_c$ represents a strain value at the central layer.

It is preferable that the step for second cold rolling is performed under high lubrication in order to satisfy $e_c \leqq e_s \leqq 1.18 e_c$. Effective methods for achieving such high lubrication include (1) maintaining the viscosity of the lubricating oil used at 20 cSt or more, (2) adding an additive for increasing the thickness of the oil film and (3) controlling the temperature of the lubricating oil so that the temperature of the sheet does not exceeds 25° C. during second cold rolling.

In the present invention, a particularly preferable composition of the magnetic steel sheet comprises 0.05 percent by weight or less of C, 5.0 percent by weight or less of Si, 2.0 percent by weight or less of Mn, 0.2 percent by weight or less of P, 0.0010 percent by weight or less of sol. Al and the balance being Fe and incidental impurities.

BEST MODE FOR CARRYING OUT THE INVENTION

(EXAMPLE 1)

Figure 1:
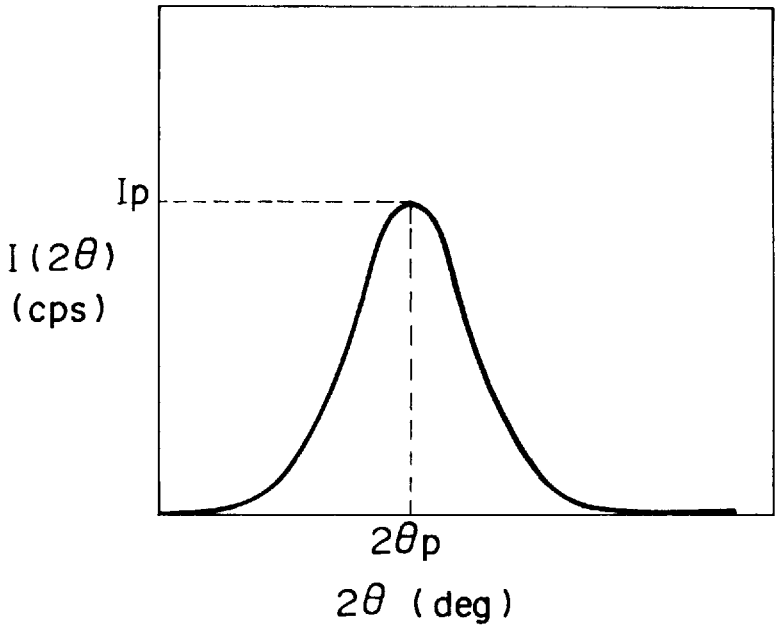
FIG. 1 is a schematic figure of an X-ray profile.
Figure 2:
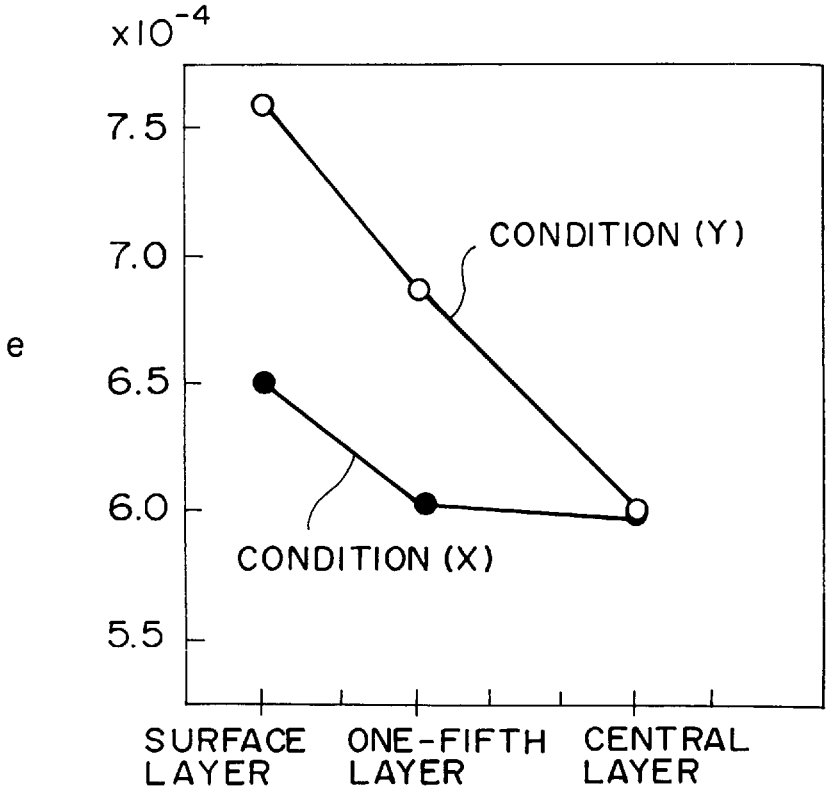
FIG. 2 is a graph for comparison of strain distributions along the thickness of the sheets based on different rolling conditions.
Figure 3:
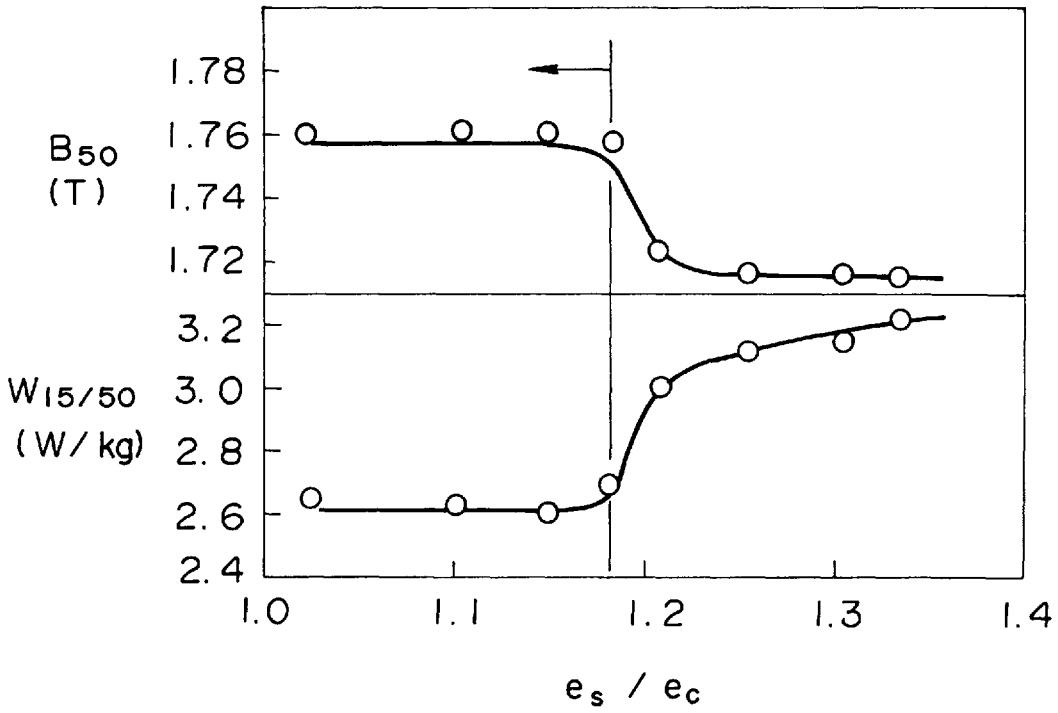
FIG. 3 is a graph showing correlations between the strain ratio, $e_s/e_c$, and magnetic characteristics.
Figure 4:
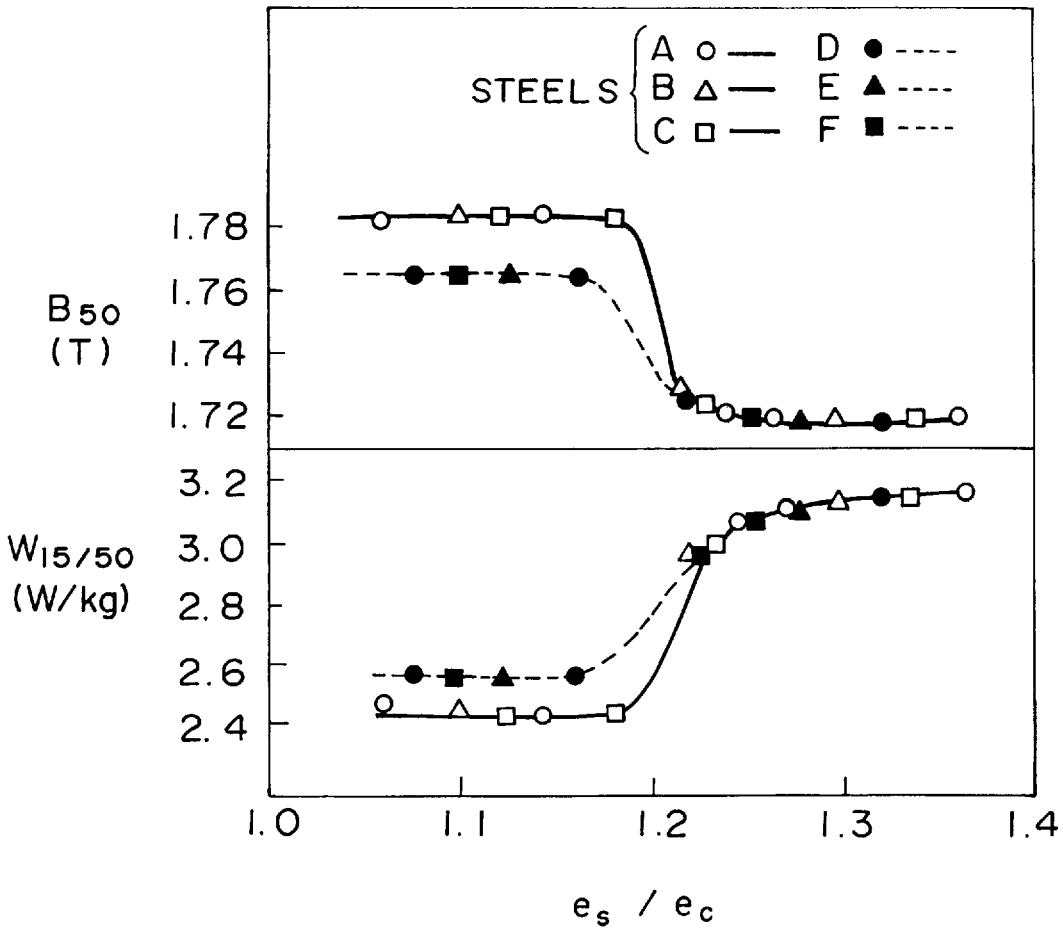
FIG. 4 is a graph showing effects of sol. Al content on the strain ratio, $e_s/e_c$, and magnetic characteristics.

Molten steels having compositions shown in Table 4 were prepared by a degassing process using a converter, and were then continuously cast into slabs. Each slab was subjected to a hot rolling process to form a hot-rolled sheet having a thickness of 0.25 mm.

The hot-rolled steel sheet was subjected to hot-rolled sheet annealing at 850° C. for 2 hours and then first cold rolling. The cold-rolled steel sheet was subjected to intermediate annealing at 800° C. for 30 seconds. The annealed sheet was subjected to second cold rolling using a lubricating oil shown in Table 5 to form a product having a thickness of 0.5 mm.

The strain values introduced to the steel sheet after second cold rolling were determined by an X-ray diffraction-profile method described above. Epstein test pieces of 280 mm by 30 mm were prepared from a second cold rolled steel sheet so that the long sides of 8 pieces among them agree with the rolling direction and the long sides of the residual 8 pieces agree with the direction perpendicular to the rolling direction. These test pieces were subjected to strain-relief annealing at 750° C. for 2 hours to measure magnetic characteristics. The results are shown in Table 5.

Method No. 1 represents a conventional process, which exhibits a high $e_s/e_c$ value and poor magnetic characteristics.

Method No. 2 represents a process in accordance with the present invention, in which 15 percent by weight of oleic acid was added to the lubricating oil in order to improve lubrication. The rolling temperature was maintained at 20° C. by cooling the lubricating oil. As a result of improved lubrication, excellent magnetic characteristics can be achieved.

Method No. 3 represents a process in accordance with the present invention which exhibits superior magnetic characteristics due to an increase in the viscosity of the lubricating oil.

Method No. 4 has a reduction rate of second cold rolling slightly lower than that in method No. 2, and method No. 5 has a reduction rate of second cold rolling slightly higher than that in method No. 2. Both methods Nos. 4 and 5 in accordance with the present invention have excellent magnetic characteristics.

[TABLE 4]

| Steel | Composition (wt %) C | Si | Mn | sol. Al | P |
|---|---|---|---|---|---|
| G | 0.0025 | 1.3 | 0.2 | 0.20 | 0.01 |
| H | 0.0020 | 1.3 | 0.2 | 0.0005 | 0.01 |

TABLE 5

| No. | Steel | Conditions of secondary cold rolling: Reduction rate (%) | Rolling speed (mcm) | Lubricating oil | Viscosity (cSt) | Rolling temp. (°C.) | $e_s/e_c$ | $B_{50}$ (T) | $W_{15/50}$ (W/kg) | Remarks |
|---|---|---|---|---|---|---|---|---|---|---|
| 1 | G | 5 | 325 | Paraffinic base oil | 25 | 40 | 1.35 | 1.72 | 3.1 | For comparison |
| 2 | G | 5 | 325 | Paraffinic base oil + 15 wt % oleic acid | 25 | 20 | 1.10 | 1.76 | 2.6 | This invention |
| 3 | G | 5 | 325 | Paraffinic base oil + 15 wt % oleic acid | 80 | 10 | 1.02 | 1.77 | 2.5 | This invention |
| 4 | G | 3 | 325 | Paraffinic base oil + 15 wt % oleic acid | 25 | 20 | 1.10 | 1.76 | 2.6 | This invention |
| 5 | G | 16 | 325 | Paraffinic base oil + 15 wt % oleic acid | 25 | 20 | 1.14 | 1.76 | 2.6 | This invention |
| 6 | G | 1 | 325 | Paraffinic base oil + 15 wt % oleic acid | 25 | 20 | 1.10 | 1.71 | 3.6 | For comparison |
| 7 | G | 20 | 325 | Paraffinic base oil + 15 wt % oleic acid | 25 | 20 | 1.12 | 1.72 | 3.5 | For comparison |
| 8 | G | 5 | 325 | Not used | — | 50 | 1.35 | 1.69 | 3.3 | For comparison |
| 9 | H | 5 | 325 | Paraffinic base oil + 15 wt % oleic acid | 25 | 20 | 1.12 | 1.78 | 2.5 | This invention |
| 10 | H | 5 | 325 | Paraffinic base oil | 25 | 20 | 1.23 | 1.72 | 3.0 | For comparison |
| 11 | G | 5 | 325 | Paraffinic base oil | 25 | 20 | 1.30 | 1.72 | 3.2 | For comparison |
| 12 | G | 5 | 325 | Paraffinic base oil + 15 wt % oleic acid | 5 | 20 | 1.25 | 1.72 | 3.3 | For comparison |
| 13 | G | 5 | 325 | Paraffinic base oil + 15 wt % Phosphate ester | 25 | 40 | 1.28 | 1.72 | 3.2 | For comparison |
| 14 | G | 3 | 325 | Naphthenic base oil + 15 wt % Phosphate ester | 40 | 18 | 1.02 | 1.77 | 2.5 | This invention |
| 15 | G | 16 | 325 | Naphthenic base oil+ 15 wt % Phosphate ester | 40 | 8 | 1.05 | 1.76 | 2.6 | This invention |
| 16 | G | 8 | 325 | Mineral oil + 15 wt % oleic acid | 80 | 8 | 1.05 | 1.76 | 2.6 | This invention |
| 17 | H | 5 | 325 | Naphthenic base oil + 15 wt % Phosphate ester | 40 | 8 | 1.12 | 1.78 | 2.5 | This invention |
| 18 | H | 10 | 325 | Paraffinic base oil + 2 wt % oleic acid | 25 | 10 | 1.28 | 1.72 | 3.1 | For comparison |

NB: Underline indicates out of the range of the present invention or a characteristic inferior to the present invention.

Each of methods Nos. 6 and 7 has a reduction rate of second cold rolling out of the range of the present invention, and thus exhibits deteriorated magnetic characteristics.

Method No. 8 using no lubricating oil has a high $e_s/e_c$ value and significantly deteriorated magnetic characteristics.

Method No. 9 in accordance with the present invention containing 0.0010% or less of sol. Al exhibits further improved magnetic characteristics.

Method No. 10 for comparison exhibits deteriorated magnetic characteristics due to a high $e_s/e_c$ value, regardless of a sol. Al content of 0.0010% or less.

Method No. 11 uses no additive for increasing the strength of the oil film. Method No. 12 has a low viscosity, and method No. 13 has a high rolling temperature. As a result, each $e_s/e_c$ value exceeds 1.18 and magnetic characteristics deteriorate.

Each of methods Nos. 14, 15 and 16 has a $e_s/e_c$ value within a range of 1.00 to 1.18 and excellent magnetic characteristics.

Method No. 17 containing 0.0010% or less of sol. Al exhibits excellent magnetic characteristics.

Method No. 18 is a comparative example to method No. 17 and contains an inadequate amount of oleic acid. Thus, the $e_s/e_c$ value exceeds 1.18 and magnetic characteristics deteriorate, regardless of a sol. Al content of 0.0010% or less.

(EXAMPLE 2)

Molten steels having compositions shown in Table 6 were prepared by a degassing process using a converter, and continuously cast into slabs. Each slab was subjected to a hot rolling process to form a hot-rolled sheet having a thickness of 0.25 mm.

The hot-rolled sheet was subjected to first cold rolling and intermediate annealing at 750° C. for 30 seconds. The annealed sheet was subjected to second cold rolling using a lubricating oil shown in Table 7 to form a product having a thickness of 0.5 mm.

The strain values introduced to the steel sheet after second cold rolling were determined by an X-ray diffraction profile method described above. Epstein test pieces of 280 mm by 30 mm were prepared from a second cold rolled steel sheet so that the long sides of 8 pieces among them agree with the rolling direction and the long sides of the residual 8 pieces agree with the direction perpendicular to the rolling direction. These test pieces were subjected to strain-relief annealing at 750° C. for 2 hours to measure magnetic characteristics. The results are shown in Table 7.

[TABLE 6]

| Steel | Composition (wt %) C | Si | Mn | sol. Al | P |
|---|---|---|---|---|---|
| J | 0.0025 | 0.10 | 0.30 | 0.20 | 0.08 |
| K | 0.0020 | 0.10 | 0.30 | 0.0005 | 0.08 |

TABLE 7

| No. | Steel | Conditions of secondary cold rolling: Reduction rate (%) | Rolling speed (mcm) | Lubricating oil | Viscosity (cSt) | Rolling temp. (°C.) | $e_s/e_c$ | $B_{50}$ (T) | $W_{15/50}$ (W/kg) | Remarks |
|---|---|---|---|---|---|---|---|---|---|---|
| 1 | J | 5 | 350 | Paraffinic base oil + 15 wt % oleic acid | 25 | 20 | 1.10 | 1.76 | 4.5 | This invention |
| 2 | J | 5 | 350 | Paraffinic base oil | 25 | 40 | 1.27 | 1.72 | 5.1 | For comparison |
| 3 | K | 5 | 340 | Paraffinic base oil + 15 wt % oleic acid | 25 | 20 | 1.10 | 1.77 | 4.6 | This invention |

NB: Underline indicates out of the range of the present invention or a characteristic inferior to the present invention.

Method No. 1 in accordance with the present invention exhibits excellent magnetic characteristics.

Method No. 2 for comparison exhibits deteriorated magnetic characteristics due to a high $e_s/e_c$ value.

Method No. 3 in accordance with the present invention having a sol. Al content of 0.0010% or less exhibits further improved magnetic characteristics.

INDUSTRIAL APPLICABILITY

As described above, a semiprocessed nonoriented magnetic steel sheet having excellent magnetic characteristics can be obtained at low cost by controlling a second cold rolling step in accordance with the present invention.

What is claimed is:

1. A semiprocessed nonoriented magnetic steel sheet having excellent magnetic characteristics containing 5.0 percent by weight or less of Si, having been cold rolled at a rolling reduction rate of 2 to 18%, so as to satisfy the following equation:

$$e_c \leqq e_s \leqq 1.18 e_c$$

wherein $e_s$ represents the strain value at the surface layer of the steel sheet after the cold rolling step and $e_c$ represents the strain value at the central layer of the steel sheet after the cold rolling step.

2. A semiprocessed nonoriented magnetic steel sheet having excellent magnetic characteristics according to claim 1, wherein the magnetic steel sheet comprises 0.05 percent by weight or less of C, 5.0 percent by weight or less of Si, 2.0 percent by weight or less of Mn, 0.2 percent by weight or less of P, 0.0010 percent by weight or less of sol. Al and the balance being Fe and incidental impurities.

3. A method for making a semiprocessed nonoriented magnetic steel sheet having excellent magnetic characteristics, said method comprising:

forming a steel sheet by hot-rolling a silicon steel material containing 5.0 percent by weight or less of Si, cold rolling said hot rolled steel sheet, intermediate annealing said cold rolled steel sheet, and cold rolling said annealed steel sheet at a rolling reduction rate of 2 to 18% and under conditions which satisfy the following equation:

$$e_c \leqq e_s \leqq 1.18 e_c$$

wherein $e_s$ represents the strain value at the surface layer of the steel sheet after cold rolling said annealed sheet and $e_c$ represents the strain value at the central layer of the steel sheet after cold rolling said annealed sheet.

4. A method for making a semiprocessed nonoriented magnetic steel sheet having excellent magnetic characteristics, said method comprising:

forming a steel sheet by hot-rolling a silicon steel material, cold rolling said hot rolled steel sheet, intermediate annealing said cold rolled steel sheet and cold rolling said annealed steel sheet at a rolling reduction rate of 2 to 18% under conditions which satisfy the following equation:

$$e_c \leqq e_s \leqq 1.18 e_c$$

wherein $e_s$ represents the strain value at the surface layer of the steel sheet after cold rolling said annealed sheet and $e_c$ represents the strain value at the central layer of the steel sheet after cold rolling said annealed sheet; the steel sheet comprising 0.05 percent by weight or less of C, 5.0 percent by weight or less of Si, 2.0 percent by weight or less of Mn, 0.2 percent by weight or less of P, 0.0010 percent by weight or less of sol. Al and the balance being Fe and incidental impurities.

5. A method for making a semiprocessed nonoriented magnetic steel sheet having excellent magnetic characteristics according to either claim 3 or 4, wherein the step of cold rolling said annealed steel sheet is performed with high lubrication.

6. A method for making a semiprocessed nonoriented magnetic steel sheet having excellent magnetic characteristics according to either claim 3 or 4, wherein the step of cold rolling said annealed sheet is performed using a lubricating oil, and the viscosity of the lubricating oil is 20 cSt or more.

7. A method for making a semiprocessed nonoriented magnetic steel sheet having excellent magnetic characteristics according to either claim 3 or 4, wherein the step of cold rolling said annealed sheet is performed using a lubricating oil, and the lubricating oil includes an additive for increasing the thickness of the lubricating oil.

8. A method for making a semiprocessed nonoriented magnetic steel sheet having excellent magnetic characteristics according to either claim 3 or 4, wherein the step of cold rolling said annealed sheet is performed using a lubricating oil, and the temperature of the lubricating oil is controlled so that the temperature of the sheet does not exceed 25° C. during second cold rolling.

* * * * *

UNITED STATES PATENT AND TRADEMARK OFFICE

CERTIFICATE OF CORRECTION

PATENT NO. : 5,876,520

DATED : March 2, 1999

INVENTOR(S) : Takashima, et al

It is certified that error appears in the above-identified patent and that said Letters Patent is hereby corrected as shown below:

In column 8, at Table 5, at the subheading "Rolling temp. (°C.), at example 8, please change "50" to --50--.

Signed and Sealed this

Twenty-ninth Day of June, 1999

*Attest:*

Q. TODD DICKINSON

*Attesting Officer*

*Acting Commissioner of Patents and Trademarks*